United States Patent [19]

Bell

[11] 4,273,022

[45] Jun. 16, 1981

[54] INSTRUMENTAL MUTE

[76] Inventor: Robert E. Bell, 224 Perth Rd., Gants Hill, Ilford, Essex, England

[21] Appl. No.: 96,313

[22] Filed: Nov. 21, 1979

[51] Int. Cl.[3] ..... G10D 9/06
[52] U.S. Cl. ..... 84/400
[58] Field of Search ..... 84/400

[56] References Cited

U.S. PATENT DOCUMENTS

| | | | |
|---|---|---|---|
| 1,307,259 | 6/1919 | Kidder | 84/400 |
| 1,578,763 | 3/1926 | Schluesselburg | 84/400 |
| 1,702,561 | 2/1929 | Santa Emma | 84/400 |
| 2,244,205 | 6/1941 | Koeder | 84/400 |
| 2,690,092 | 9/1954 | Martin | 84/400 |

FOREIGN PATENT DOCUMENTS

| | | | |
|---|---|---|---|
| 3145 | 11/1877 | Fed. Rep. of Germany | 84/400 |
| 9612 | of 1895 | United Kingdom | 84/400 |

*Primary Examiner*—Lawrence R. Franklin
*Attorney, Agent, or Firm*—Emory L. Groff, Jr.

[57] ABSTRACT

An instrumental mute is provided which is capable of use as a 'straight,' 'cup' or 'wah-wah' type mute in muting sounds produced by wind instruments. The apparatus comprises a vessel 1 internally divided into first and second adjacent chambers 9 and 10 respectively, support means 5 enabling the vessel to be secured within an instrument bellmouth and including a cylindrical portion allowing communication between the chambers 9 and 10, the vessel 1 being displaceable along an extension 12 by rotation about screw thread 18, to open or close the instrument bellmouth.

11 Claims, 6 Drawing Figures

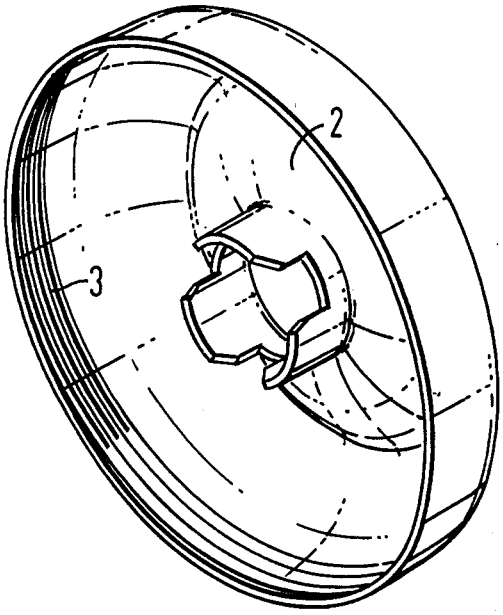
FIG. 3
FIG. 4
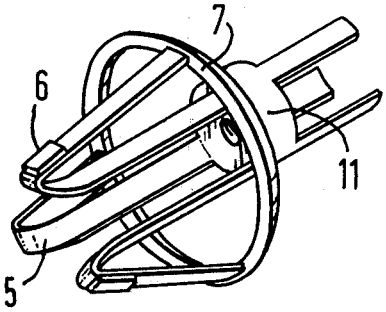
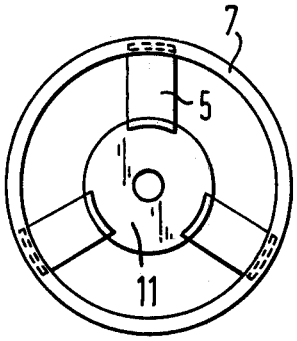
FIG. 5
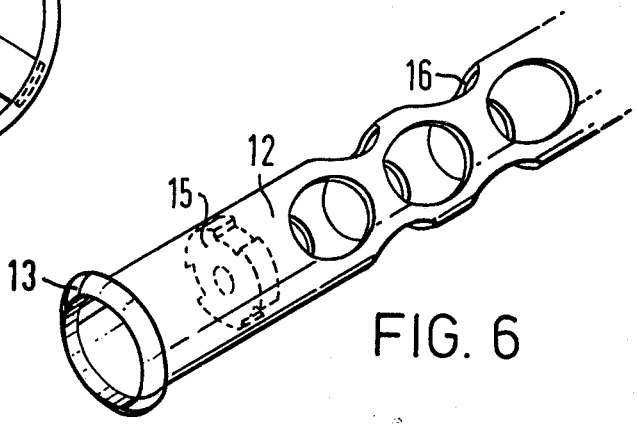
FIG. 6

INSTRUMENTAL MUTE

BACKGROUND OF THE INVENTION

This invention relates to an improved mute intended for use in variably muting sounds produced by brass wind instruments.

An object of the invention is to provide an apparatus capable of being used as a 'straight,' 'cup' or 'wah-wah' type mute.

SUMMARY OF THE INVENTION

According to this invention there is provided an apparatus for muting sounds produced by wind instruments, the apparatus comprising a vessel internally divided into first and second adjacent chambers, chamber closure means to either prevent or allow communication between said chambers by adjustment thereof, support means for securing the vessel to an instrument, the arrangement being such that the vessel is displaceable towards and away from said instrument to open or close one of said chambers to the instrument bellmouth.

Preferably, the mouth of the vessel engages the support means, an extension of the latter extending through the vessel and upon which one end of the vessel may be mounted.

Muting accessories including cone types, baffle types and wah-wah type inserts are preferably enterable within the support means extension forming a close fit therewith.

The support means is preferably adapted to engage a wind instrument bellmouth and includes apertures through which sounds produced by the instrument pass into both first and second chambers only or pass into the first chamber and outside of the vessel.

The support means may include exterior segments of cork or similar frictional material, enabling a snug fit with an instrument bellmouth, and a sealing collar of nylon or similar soft plastic which engages the exterior surface of the vessel when the vessel is displaced, towards the instrument bellmouth, providing a gasket type seal between bellmouth and vessel exterior surface.

A similar gasket is preferably located at one end of the support means extension, which forms a seal at the mouth of the second chamber, when the vessel is displaced away from the bellmouth.

The invention will now be described by way of example with reference to the accompanying drawings, illustrating an embodiment.

BRIEF DESCRIPTION OF THE DRAWINGS

FIG. 3 is an isometric view of the end segment of the mute body;

FIG. 4 illustrates the retaining and sealing means of the supporting means;

FIG. 5 is an end elevation of FIG. 4; and

FIG. 6 illustrates the extension member of the supporting means.

DESCRIPTION OF THE PREFERRED EMBODIMENTS

Figure 1:
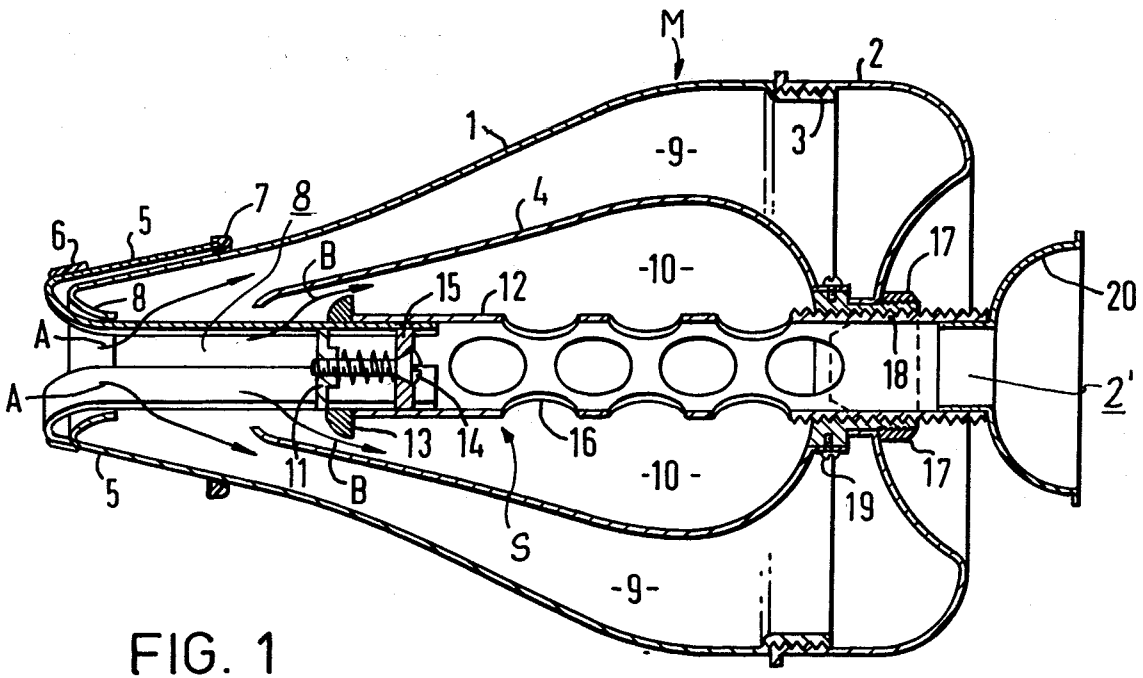
FIG. 1 is a cross-sectional view of a mute according to the present invention.
Figure 2:
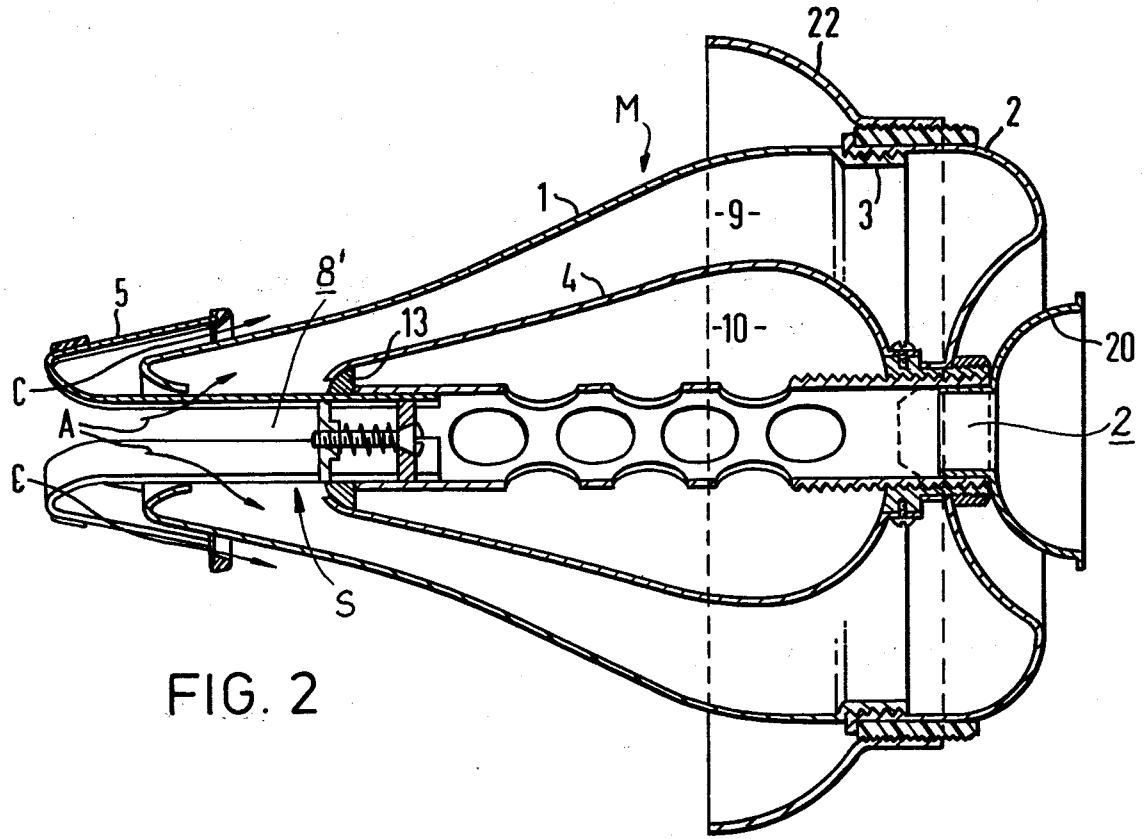
FIG. 2 is a cross-sectional view of the mute in an extended or second position.

Referring firstly to FIG. 1, the muting apparatus includes body means M comprising a generally conical element 1 having lips 8 defining inlet means 8' at the rear or mouth of the body means and a joining end segment 2 having outlet means 2' screw threaded at 3 to engage mating threads in the conical element 1. A generally pear-shaped internal element 4 is disposed within the conical element 1 and suitably affixed relative the end segment 2 to provide first 9 and second 10 chambers as shown in FIGS. 1 and 2.

Supporting means, generally designated S, extends axially through the body means M and includes rearmost retaining means comprising a plurality of flanges or fins 5 disposed through the body inlet means 8' defined by the lip 8 and extending around the exterior of the conical element 1. The outer periphery of the fins 5 include a cork or plastic lining 6 adapted to engage an instrument bellmouth (not shown) to retain the mute therein.

Sealing means, in the form of a circular ring or collar 7, joins the distal portions of the plurality of fins 5 to serve as a ring gasket seal between the exterior of the mute conical element 1 and an instrument bellmouth when the body means M is shifted rearwardly relative the supporting means S, to the first or closed position as shown in FIG. 1 of the drawings. In this described mode or position it will be appreciated that all sound from an instrument will be constrained to enter the inlet 8' and the chambers 9 and 10 and all sound reaching the surrounding atmosphere will be that sound that issues from the outlet means 2' as will be apparent hereinafter.

The supporting means S includes a tubular extension 12 connected at its rear to the retaining means fins 5 and projecting forwardly through the body means outlet 2'. This connection is achieved by means of a spring-loaded screw 14 disposed through a fixture plate 15 within the extension 12 and engaging a threaded insert 11 carried by the retaining means fins 5.

The cylindrical supporting means extension 12 includes a plurality of apertures 16 allowing passage of sound from within the chamber 10 through the extension and outwardly therefrom through the outlet means 2' to the atmosphere when the mute is utilized in the first, closed position of FIG. 1.

Axial shifting of the supporting means S relative the body means M is achieved by means of a threaded connection therebetween. As shown in FIG. 1, the forward portion of the extension 12 is threaded at 18 and cooperates with the threaded collar 17 which latter also serves to secure the internal element 4 as an integral part of or in assembly with the body means M. The aforedescribed screw attachment 14 and threaded components 17–18 will be understood to allow the mute apparatus to be assembled and dismantled with relative simplicity, allowing adjustment to accommodate the varying bellmouth geometry of different manufacturers.

With the above construction in mind, it will be appreciated that the body means M is readily shiftable from the first, closed position of FIG. 1 to the second, extended position of FIG. 2 simply by rotating the body components 1 and 2 together with the internal element 4 about the threaded portion 18 of the stationary supporting means S. As previously described, when the mute is in the first position of FIG. 1, the rear portion of the conical element 1 is displaced rearwardly until the sealing means 7 is sandwiched between the exterior surface of the element 1 and the instrument bellmouth such that all sound from the instrument must pass through the inlet means 8' and thence follow the paths A and B into the chambers 9 and 10 respectively. As will be seen, all sound issuing into the atmosphere from the instrument with the mute in this mode will pass through the apertures 16 and thence through the outlet means 2'. Any suitable muting accessory, such as the illustrated wah-wah type 20, may be inserted within the extension 12 disposed within the outlet means 2'.

The mute is readily adjusted to provide an alternate mode as illustrated by the extended, second position of FIG. 2 wherein the body means M has been shifted outwardly relative the supporting means S to position the rear portion of the conical element 1 and its exterior surface well spaced inwardly of the distal portions of the fins 5 and the sealing means 7. During this shifting motion, closure means carried by the supporting means and comprising a sealing collar 13, is engaged by the rear portion of the internal element 4 and effectively closes access to the chamber 10 and thus prevents communication of sound from the inlet 8' to the outlet 2' such that all sound from the instrument issues directly to the atmosphere via path C with that sound following the path A being fully trapped within the closed interior of the body means as depicted in FIG. 2. The apparatus in this position functions as a straight mute or cup type mute, the accessory 20 not functioning. An exterior sliding cup 22 fits around the apparatus in close proximity to the instrument bellmouth.

A detail of the end segment 2 with its screw thread 3 is shown in FIG. 3.

FIGS. 4 and 5 show a preferred arrangement of that portion of the supporting means S with the fins 5 having the cork lining 6 and the sealing collar 7 conjoining the ends of each fin 5. The threaded insert 11 is arranged to lie between the fins 5, to receive the spring-loaded screw 14 serving to join this portion of the supporting means to the extension 12.

Referring to FIG. 6, the supporting means cylindrical extension 12 is shown more clearly along with its apertures 16 through which sound may pass and the internal fixture plate 15 for receiving the screw 14.

Two extreme relative positions have been described herein. Quite obviously, the body means M may be shifted to any one of alternate positions intermediate the two illustrated extreme positions to achieve other variations in sound with the sound issuing both exteriorly of the conical element along the path C and interiorly thereof along the path B.

The apparatus in accordance with the invention thus provides a versatile mute which eliminates the need to carry a plurality of conventional single tone mutes and has the capacity to receive a number of lightweight muting accessories.

I claim:

1. A mute for insertion within the bellmouth of a wind musical instrument comprising: body means enclosing at least one internal chamber, said body means including inlet means permitting sounds from said bellmouth to enter said chamber and outlet means permitting said sounds to exit from said chambers and supporting means including retaining means, adjusting means, sealing means and closure means, said retaining means adapted to retain said mute in said bellmouth; said adjusting means permitting said body means to be adjusted relative to said supporting means in at least two positions; said sealing means selectively (1) acoustically sealing said body means and said bellmouth when said body means is in a first adjusted position, to constrain said sounds to enter said chamber, and (2) spacing said body means from said bellmouth, when said body means is in a second adjusted position, to allow said sounds to both exit exteriorly of said body and enter said chamber, and said closure means selectively (1) opening communication of said sounds to said outlet means, when said body means is in said first position, and (2) closing communication of said sounds to said outlet means, when said body means is in said second position, whereby when said body means is in said first position, said sounds are constrained to pass into said inlet means, through said internal chamber, and out said outlet means, and when said body means is in said second position, said sounds are allowed to pass exteriorly of said body means as well as into said chamber but not out of said outlet means.

2. A mute according to claim 1 wherein, said supporting means includes a tubular extension within said chamber disposed through said body outlet means and joined to said retaining means, and said closure means mounted upon said tubular extension.

3. A mute according to claim 2 wherein, said tubular extension is provided with a plurality of apertures allowing said communication of sounds from said chamber through said outlet means when said body means is in said first position.

4. A mute according to claim 2 including, muting accessories selected from cone, baffle or wah-wah types insertable within said extension adjacent said outlet means.

5. A mute according to claim 2 wherein, said body means includes a conical element joined to a forward end segment, a pear-shaped element disposed within said conical element and defining another chamber within said body means and said pear-shaped element having a rear mouth surrounding said supporting means and engageable with said closure means when said body means is displaced away from said bellmouth into said second position.

6. A mute according to claim 5 wherein, both said chambers are in open communication with said inlet means when said body means is in said first position and only one said chamber is in communication with said inlet means when said body means is in said second position.

7. A mute according to claim 2 including, a fixture plate within said extension adjacent said retaining means, a threaded insert attached to said retaining means adjacent said extension, and a spring-loaded screw through said plate and into said insert to join said extension to said retaining means.

8. A mute according to claim 1 wherein, said body means includes a conical element having a rear portion provided with said inlet means and engageable with said retaining means.

9. A mute according to claim 1 wherein, said adjusting means includes mating threads surrounding said supporting means and said outlet means.

10. A mute according to claim 1 wherein, said retaining means includes segments of frictional material engageable with said instrument bellmouth and said sealing means includes a collar providing a gasket seal between the exterior of said body means and said bellmouth when said body means is in said first position.

11. A mute according to claim 1 wherein, said retaining means includes a plurality of fins extending (1) rearwardly through said outlet means (2) outwardly toward said bellmouth and (3) forwardly juxtaposed the exterior of said body means.

* * * * *